United States Patent [19]

Wing, Jr. et al.

[11] Patent Number: 4,869,981

[45] Date of Patent: Sep. 26, 1989

[54] ELECTROSTATIC METHOD FOR MULTICOLOR IMAGING FROM A SINGLE TONER BATH

[75] Inventors: Feagin A. Wing, Jr., Farmington; Roger W. Day, Meriden; Willard F. Burt, Bristol, all of Conn.

[73] Assignee: Olin Corporation, Cheshire, Conn.

[21] Appl. No.: 171,614

[22] Filed: Mar. 23, 1988

[51] Int. Cl.[4] ..... G03G 13/01; G03G 9/08

[52] U.S. Cl. ..... 430/42; 430/45; 430/47; 430/106; 430/138

[58] Field of Search ..... 430/42, 45, 47, 138, 430/106

[56] References Cited

U.S. PATENT DOCUMENTS

| | | | |
|---|---|---|---|
| 3,832,170 | 8/1974 | Nagamatsu et al. . | |
| 3,833,293 | 9/1974 | Serio et al. | 355/17 |
| 3,854,942 | 12/1974 | Akman . | |
| 4,081,949 | 1/1989 | Misono et al. | 346/76 |
| 4,551,407 | 11/1985 | Sanders | 430/138 |
| 4,554,235 | 11/1985 | Adair et al. | 430/138 |
| 4,647,182 | 5/1987 | Pierce | 355/4 |

FOREIGN PATENT DOCUMENTS 2133899B 2/1986 United Kingdom .

OTHER PUBLICATIONS

Chemical Week, "Mead Brings Color to Business", Dec. 13, 1987, pp. 32–33.

Chemical & Engineering News, "New Color Technology Uses Microcapsules", Jan. 11, 1988, p. 23.

CAFC Opinion published Feb. 20, 1989, in re Wright, 9 USPQ 2d 1649–1653 referring to U.S. application Ser. No. 770,538, to R. F. Wright, filed Aug. 28, 1985 and assigned to Mead Corporation.

*Primary Examiner*—Paul R. Michl
*Assistant Examiner*—Jeffrey A. Lindeman
*Attorney, Agent, or Firm*—Dale Lynn Carlson

[57] ABSTRACT

An electrostatic method is disclosed for providing multicolor imaging from a single toner bath. The toner bath is a blend of individual toners, each of which contains a color precursor different from the others.

22 Claims, No Drawings

ELECTROSTATIC METHOD FOR MULTICOLOR IMAGING FROM A SINGLE TONER BATH

FIELD OF THE INVENTION

This invention relates generally to electrostatic imaging systems, and more particularly, to a method for providing multicolor imaging from a single toner medium using microencapsulated toner.

BACKGROUND OF THE INVENTION

Conventional multicolor electrostatic imaging systems utilize a separate toner bath to develop each desired color. This use of separate toner baths is relatively expensive from the standpoint of equipment complexity, cost, maintenance and processing time expended. It also requires multiple mechanical registrations to produce the multicolor image—a requirement fraught with the potential for error.

As an alternative to the use of toners and electrostatic imaging, a recent development in the industry utilizes an imaging sheet of paper completely coated on one side with microencapsulated color precursors. A portion of the microcapsules on the sheet is selectively hardened by exposure to light. The microcapsules having the desired color precursor in the image areas have liquid cores which remain unhardened. These unhardened microcapsules are then ruptured to release liquid color precursor. The thus-released color precursor is contacted with a color developer to provide the color image, generally by transfer to a developer sheet via pressure contact of the imaging sheet with the developer sheet. Alternately, the color precursor-containing capsules are coated directly on a layer of developer material, which itself had previously been coated on a paper support.

By way of illustration, such a transfer imaging system containing microencapsulated color precursors is disclosed in U.S. Pat. No. 4,554,235, assigned to Mead Corporation. In a variation of this type of system, U.S. Pat. No. 4,501,809, assigned to Mitsubishi Paper Company, discloses a recording sheet containing two different types of photo- and pressure-sensitive microcapsules—one set containing color precursors and the other set containing color developer. Upon rupture of unhardened microcapsules on the recording sheet after selective exposure of the recording sheet to light in imagewise registration with an image to be copied, a color image is formed on the recording sheet.

The color imaging systems illustrated by the above-cited patents possess a common disadvantage. Both systems utilize an imaging or developer sheet containing microcapsules across a full surface of the sheet. Since in many color imaging applications the desired color image rarely occupies the full sheet, and, indeed, often occupies less than half of the full sheet, there is a significant amount of waste attributable to the unused microcapsules and associated color precursor or developer contained on the non-imaged areas of the sheet. In addition, there is a substantial time and energy waste attributable to the need for photohardening the "unused" waste microcapsules using, for example, a scanning laser.

In view of the above, a new system for multicolor imaging utilizing microcapsules which does not result in such substantial waste of microcapsules and the associated colorant materials, plus wasted time and energy due to the need for photohardening of the waste microcapsules, would be highly desired by the color imaging community.

SUMMARY OF THE INVENTION

In one aspect, the present invention relates to a color imaging method which comprises the steps of:

(a) forming a latent image on a photoreceptor substrate, in any of a variety of known manners, for example by depositing a charge on a photoconductor and imagewise discharging, or imagewise depositing a charge on a dielectric material, (b) electrostatically depositing a blended toner composition onto the latent image or onto a discharged surface of said substrate to form a toned image which is a positive or reverse image as compared to said latent image, said blended toner composition comprising at least two different toners, each of said toners comprising a different color precursor contained in photo-sensitive toner particles, (c) selectively photohardening or photosoftening at least a portion of said toner particles by imagewise exposure to appropriate wavelengths of radiation to provide harder toner particles and softer, rupturable toner particles, (d) transferring said harder toner particles and said rupturable toner particles to a copy surface, (e) rupturing at least a portion of said rupturable toner particles on said copy surface to release color precursor(s) from said rupturable toner particles, and (f) contacting said color precursor(s) on form a color image on said copy surface. In another aspect, step (d) of the above method is effected before carrying out step (c). Carrying out step (e) before step (d) is also within the scope of this invention, as are other orders for the steps.

DETAILED DESCRIPTION OF THE INVENTION

In accordance with the present invention, it has now been surprisingly found that multicolor images can be formed using a single toner medium. The toner medium is a blend of 2, 3, 4, or more types of color-forming toner particles that are also photo-sensitive. The relative simplicity and economy of this technique is expected by the present inventors to make it of significant benefit to the color imaging systems community. Key advantages of this invention include the ability to: (a) utilize a single toner bath for multicolor imaging (b) selectively limit the use of toner on the imaging or developer sheet to areas on the sheet where an image is desired, and (c) avoid the need for multiple mechanical registrations for multicolor imaging.

The toner composition useful in the method of the present invention is a toner blend. This blend contains at least two different types of toner particles in order to provide at least two (preferably at least three or four) different color precursors. As used herein, the term "toner particle" is intended to designate any of a variety of particle forms which can be used to contain or carry and isolate color precursors. Typical examples of particle forms are microcapsules, microsponges, softenable solid particles, and emulsion micelles. A "toner blend" or "blended toner" designates a mixture of different color-forming toner particles or toners which enables multicolor imaging using a single toner blend. If full-color imaging capability is desired, three or four (cyan, yellow, magenta, and optionally black) color precursors are typically utilized, each toner particle preferably containing one color precursor. Other color precursors (e.g., red, green, or blue) can be used as desired. Either a liquid or a dry toner blend can be used.

The method of the present invention provides the above-described advantageous result using a multi-step method of color imaging. In the first two steps, a latent image and then an uncolored, toned image are formed in typical electrostatic fashion on a support, typically a drum, web, or sheet. In the subsequent steps, the desired color is developed by taking advantage of the photosensitivity differences of the toner particles containing the individual color precursors. These photosensitivity differences are suitably produced by using a different photoinitiator for each separate color precursor employed in the toner blend.

In a typical electrostatic method, the latent image is formed by known means. First, a blanket positive or negative charge is typically applied to a surface photoreceptor substrate, suitably a photoconductive drum, web, or sheet, by means of a corona. Portions of the surface of the photoreceptor are then selectively discharged. This selective discharge is suitably effected using light (desirably using a laser light source). The surface of the selectively-discharged photoconductor contains a latent image on either the charged portions of the surface (for positive development) or on the discharged portions of the surface (for reversal development). (An alternate method for forming the latent image typically uses an ion-generating cartridge or a charging head ("stylus") to deposit charges on a dielectric substrate, as is well-known in the art.) Once the latent image has been formed on the photoreceptor, a toner blend having a charge characteristic either opposite from (for positive development) or the same as (for reversal development) the charge on the selectively-discharged photoreceptor is then applied onto the surface of the photoreceptor. Typically, the toner blend is applied to the photoconductive surface from a liquid toner bath, or in the case of a dry toner by means of a magnetic brush. A variety of development methods is usable and known to practioners of the art. The photo-sensitive toned image on the photoreceptor is then selectively hardened (i.e., photopolymerized) (or in some embodiments softened, i.e., photodepolymerized) by exposure to radiation of a specified wavelength. This photopolymerization or photodepolymerization is carried out to cause only toner particles containing desired color precursors to be rupturable for releasing color precursors. For example, if a yellow image is desired, the toned image will be exposed to wavelengths of light which will cause the toner particles containing the cyan, magenta, and black color precursors to be hardened. Likewise if a green image is desired, the toned image will be exposed to wavelengths of light which cause the toner particles containing the magenta and black color precursors to selectively harden. All known colors can be likewise caused to form by exposure of toner particles to the appropriate wavelengths of light and then completing the imaging process. Additionally, the deliberate creation of partially hardened toner particles will give rise to intensity variations of the color produced.

The toned image, composed of both hardened (or harder) and rupturable (or softer) toner particles, is then transferred to a copy sheet by known procedures. For example, this transfer is suitably effected by passing the substrate to be printed, such as a copy sheet of paper or a transparent film, between the photoreceptor and a transfer corona, thereby causing the toner particles to transfer from the photoreceptor to the copy sheet.

Once on the copy sheet, the rupturable toner particles of those making up the toned image are ruptured, typically by radiation, heat, pressure or a combination of these procedures (preferably by pressure) to release the desired color precursors. These desired color precursors are then developed by contact with a developer.

The toner particles, comprising what is referred to herein as "a toner blend" or "blended toner", in one preferred embodiment typically have a shell and a core. The core preferably contains the color precursor and the photosensitive composition. The shell is generally positively or negatively charged and can be made of various materials known in the art. Typical shell materials include, for example, melamine resins, urethanes, or urea-formaldehyde. The average size of the particles is generally between about 0.1 and about 100 microns, preferably between 0.5 and 20 microns. For liquid toners, an average toner particle size is suitably between about 0.1 and about 10 microns whereas a particularly suitable particle size for dry toners is between about 1 and about 20 microns.

Typically, the core of the toner particles contains photohardenable, photosensitive composition(s). The viscosity of the core of the toner particles is increased substantially upon exposure to the appropriate wavelengths of radiation through mechanisms such as crosslinking or polymerization. When the toner which polymerized upon exposure to radiation will flow very little, if at all, while the unexposed or weakly exposed photosensitive composition can flow relatively freely. As a direct result, the chromogenic material (i.e., the color precursor) reacts with the developer according to the inverse of the degree of exposure to the appropriate wavelength of radiation to form the desired color in the desired image area.

In an alternative embodiment, the photosensitive composition can be a high-viscosity composition which undergoes a substantial decrease in viscosity upon exposure to actinic radiation of the appropriate wavelength. In that case, the chromogenic material located in or on the exposed toner particles, is therefore made accessible to the developer upon rupture of the particles.

The photosensitive composition includes a material which undergoes a change in viscosity upon exposure to light, either alone or in conjunction with a photoinitiator. The photosensitive composition may be photohardenable, such as a monomer, dimer, or oligomer which is polymerized to a higher-molecular-weight compound or it may be a polymer which is polymerized further, e.g., by crosslinking. Alternatively, it may be a composition which is depolymerized or otherwise made less viscous upon exposure to light. Suitable radiation-curable materials include materials curable by free radical-initiated, chain-propagated, addition polymerization or ionic polymerization.

Representative photosensitive compositions are ethylenically unsaturated organic compounds. These compounds contain at least one ethylenic group per molecule. Typically they are liquid at room temperature and can also double as a carrier oil for the chromogenic material in the toner core. A preferred group of radiation-curable materials is ethylenically unsaturated compounds having two or more ethylenic groups per molecule. Representative examples of these compounds include ethylenically unsaturated acid esters of polyhydric alcohols such as trimethylol propane triacrylate or trimethacrylate, acrylate prepolymers derived from the partial reaction of pentaerythritol with acrylic or methacrylic acid or acrylic or methacrylic acid esters; isocyanate modified acrylate, methacrylic and itaconic acid esters of polyhydric alcohols, etc.

Some typical examples of photosoftenable materials useful in other embodiments are photolysable compounds such as certain diazonium compounds, poly(3-oximino-2-butanone methacrylate) which undergoes main chain scission upon UV exposure, poly(4-alkyl acylo-phenones), and certain resins having a quinone diazide residue.

Photoinitiators are optionally used in accordance with the method of the present invention to selectively photoharden or photosoften the toner particles as desired. The photoinitiator is typically responsive to a specific wavelength and/or amount of actinic radiation. These, alone or in conjunction with a sensitizer, are compounds which absorb the exposure radiation and generate a free radical with or without the aid of co-initiator. If a system which relies upon ionic polymerization is used, the photoinitiator may be the anion- or cation-generating type, depending on the nature of the polymerization. Suitable photoinitiators include alkoxy phenyl ketones, Michler's ketone, acylated oximinoketones, polycyclic quinones, benzophenones, substituted benzophenones, xanthones, thioxanthones, halogenated compounds such as chlorosulfonyl and chloromethyl polynuclear aromatic compounds, chlorosulfonyl and chloromethyl heterocyclic compounds, chlorosulfonyl and chloromethyl benzophenones and fluorenones, haloalkanes, halo-phenylacetophenones; photoreducible dye/reducing agent redox couples, halogenated paraffins (e.g., brominated or chlorinated paraffin) and benzoin alkyl ethers.

If used, the amount of photoinitiator employed in the photosensitive composition to initiate polymerization (i.e., photoharden) or depolymerization (i.e., photosoften) of the photosensitive composition in the toner particles will depend upon the particular photosensitive composition selected, the particular photoinitiator selected, and the photohardening or photosoftening speed desired. The photoinitiator is preferably employed in an amount of between about 0.1 and about 30 (preferably between about 1 and about 10) weight percent based upon the total weight of the toner particles.

Other additives can be employed in the toner particles such as carrier oils, e.g., deodorized kerosene or alkylated biphenyls. Curing agents can also be used. These are free-radical generators such as thermal initiators, which upon reacting with the photosensitive composition cause it to polymerize or crosslink. After selectively exposing the composition to actinic radiation, and rupturing the particles in the presence of a developer material, the chromogenic material and the developer react to produce color in the form of an image, the curing agent then reacts with the released photosensitive composition and hardens it, thereby preventing image diffusion or degradation. In the case of certain curing agents, it may be desirable to heat the image to accelerate the cure. A curing agent is preferably selected which is relatively inactive at room temperature (for good shelf life) and which is readily activated by heating to temperatures in excess of room temperature.

A particularly useful class of thermal initiators reactive with ethylenically unsaturated compounds are organic peroxides. Suitable peroxides include diacyl peroxides, ketone peroxides, peroxydicarbonates, alkyl peroxides, allyl hydroperoxides and sulfonyl peroxides. Also useful as thermal initiators are bisazides, perborates and diazo compounds.

The method of the present invention is expected to have commercial application in making full-color prints, transparencies and slides, as well as full-color computer-generated images and full-color xerographic copies.

The following examples are intended to illustrate, but in no way limit the scope of, the present invention.

EXAMPLE 1

Preparation of Individual Toners, Followed by Toner Blend Preparation and Multicolor Imaging Using the Toner Blend

(A) (1) Aqueous Preparation of Blue-Color-Forming Toner Particles

Blue-color-forming toner particles, which were photosensitive to near-ultraviolet radiation, were prepared in water in the following manner. A solution was prepared by dissolving 5.0 g of ethylene-maleic anhydride copolymer (1:1 mole ratio; 80,000 MW) and 1.0 g of sodium hydroxide in 45.0 g of water with stirring and heating at 90° C. for two hours. Then 100 g of water was added and the solution cooled to 55° C. The pH was adjusted from 4.3 to 4.00 with 10 percent sulfuric acid and the temperature was maintained at 55° C. until the solution was used. The toner core solution was prepared by first mixing 60.14 g of trimethylolpropane triacrylate (TMPTA) and 16.55 g of methyl methacrylate (MMA). To this was added 4.52 g of COPIKEM® IX (a product of Hilton-Davis), a blue-dye precursor, which was dissolved by heating to 75° C. and strirring. After the dye precursor was dissolved, this solution was allowed to cool to room temperature. Then 5.20 g of Michler's ketone, a UV-sensitive photoinitiator, was added with stirring that was continued until the photoinitiator dissolved. 37.53 g of CYMEL® 385 (a modified melamine-formaldehyde resin, a product of American Cyanamid) was warmed to about 50° C.

The solution of ethylene-maleic anhydride copolymer was added to a jacketed blender which was heated to 55° C. by means of circulated water. The blender power setting was controlled to 40 volts by means of a variable transformer. Next, the core solution was added and the blender power setting was increased to 90 volts for 45 seconds to disperse the core liquid into small droplets. The blender power was reduced to 40 volts and the CYMEL® 385 (a modified melamine-formaldehyde resin, a product of American Cyanamid) was added to the blender. Stirring and heating at 55° C. were then continued for two hours.

The blue-color-forming toner particles were later isolated as a dry powder by spray drying.

(A) (2) Aqueous Preparation of Magenta-Color-Forming Toner Particles

Magenta-color-forming toner particles, which were photosensitive to blue light, were prepared in water in the following manner. A solution was prepared by dissolving 5.0 g of ethylene-maleic anhydride copolymer and 1.0 g of sodium hydroxide in 45.0 g of water by stirring and heating at 85° C. for two hours. To this was added 100 g of water and the temperature was adjusted to 55° C. The pH was adjusted from 4.27 to 4.00 with 10 percent sulfuric acid and the temperature was maintained at 55° C. until the solution was used. The toner core solution was prepared by first mixing 60.11 g of trimethylolpropane triacrylate and 16.56 g of methyl methacrylate. To this was added 4.52 g of COPI-KEM® XX (a product of Hilton-Davis), a magenta dye precursor, which was dissolved by heating to 75° C. and stirring. After the dye precursor dissolved, the mixture was cooled to room temperature and 2.64 g of camphorquinone and 2.37 g of triethanolamine were added. Stirring was continued until the photoinitiator and hydrogen doner dissolved.

The solution prepared from the ethylenemaleic anhydride copolymer was added to a jacketed blender which was heated and maintained at 55° C. by means of circulated water. The blender power setting was controlled to 40 volts by means of a variable transformer. Next, the core solution was added and the seconds to disperse the core liquid into small blender power setting was increased to 90 volts for 45 droplets. The blender power was reduced to 40 volts and 37.4 g of CYMEL® 385 modified melamine-formaldehyde resin, a product of American Cyanamid), which had been preheated to about 50° C., was added to the blender. Stirring and heating at 55° C. were then continued for two hours.

The magenta-color-forming toner particles were later isolated as a dry powder by spray drying.

(B) Preparation of the Toner Blend and Electrostatic Photoselective Formation of a Multicolored Image A liquid blended toner was prepared by combining 2.0 g of the dry, blue-color-forming toner powder prepared as in Section (A) (1), 2.0 g of the dry, magenta-color-forming toner powder prepared as in Section (A) (2), and 196 g of a liquid hydrocarbon having a low dielectric contant, ISOPAR G® (a product of Exxon Chemical Company). This mixture was first stirred in a beaker and then transferred to a jar and shaken.

A charged latent image was formed on a sheet of electrostatic paper (a product of Versatec Inc.) by means of a steel piece, 1½ inches wide by 3 inches long, which was connected to a DC power supply set at 750 volts. The electrostatic paper was laid on a flat aluminum ground plate and the steel piece, which was connected to the positive lead from the power supply, was held in contact with the paper surface for 60 seconds with the power on. The paper was then dipped into the liquid blended toner. Upon removal of the paper, a non-colored toned image was visible which exactly corresponded in area and location to the place of contact by the charged, steel piece. The toned image on the sheet was allowed to dry at room temperature.

Color-imagewise exposure of the non-colored, toned image was carried out in the following manner (see TABLE I below). The area upon which the toner had been deposited was covered by a contact mask (Mask A) which was subdivided into four areas with Areas 1 and 4 being opaque and Areas 2 and 3 being transparent. The mask was then covered with a glass, band-pass filter (Filter A) (Model No. 51800, a product of Oriel Corporation) which only passe light having wavelengths between 225 and 400 nm (UV). The toned image area was then irradiated through Filter A and Mask A with a mercury lamp. Thus, Areas 2 and 3 were exposed to light of 225–400 nm and Areas 1 and 4 were not. Filter A and Mask A were then removed and the toned image area was then covered by a mask (Mask B). Mask B had four areas corresponding to Areas 1–4 of Mask A except that in Mask B, Areas 1 and 3 were opaque and Areas 2 and 4 were transparent. This mask was then covered with a glass, long-pass filter (Filter B) (Model No. 51482, a product of Oriel Corporation) which only passed light with wavelengths greater than 420 nm. The toned image area was then irradiated through Filter B and Mask B with the same mercury lamp as before. Thus, Areas 2 and 4 were exposed to light of wavelengths greater than 420 nm and Areas 1 and 3 were not. Filter B and Mask B were then removed.

In the areas exposed to the UV light (225–400 nm through Filter A), the blue-color-forming toner particles were hardened because they contained a photoinitiator sensitive to the UV light. In the areas exposed to the light of wavelength greater than 420 nm, the magenta-color-forming toner particles were hardened because they contained a photoinitiator sensitive to blue light.

The toned image area was then placed in contact with a developer sheet (20 #, white, *NCR paper TM* supplied by Appleton Papers, Inc.) and pressure was then applied to rupture the toner particles that had not purple (subtractive combination of blue and magenta), white, magenta, and blue areas. The purple color was produced in Area 1, which was not irradiated in either exposure. Thus, neither type of toner particle was hardened. The white region was produced in Area 2 which was irradiated by both exposures, thus hardening both types of toner particles. The magenta color was produced in Area 3, which was irradiated during only the first exposure, thus causing only the blue-color-forming toner particles to be hardened. The blue color was produced in Area 4, which was irradiated during only the second exposure, thus causing only the magenta-color-forming toner particles to be hardened.

The results in terms of the color produced for each of the various areas of the image are summarized in TABLE I below.

TABLE I

| Area | Mask A | First Exposure Filter A nm | Mask B | Second Exposure Filter B nm | Color-Former Hardened | Color Produced |
|---|---|---|---|---|---|---|
| 1 | opaque | — | opaque | — | none | purple |
| 2 | trans-parent | 300–400 | trans-parent | >420 | both | white |
| 3 | trans-parent | 300–400 | opaque | — | blue | magenta |
| 4 | opaque | — | trans-parent | >420 | magenta | blue |

Note that the resulting colors included purple, magenta, and blue, as well as a portion of the image having the white coloration of the paper.

EXAMPLE 2

Proposed Example for Multicolor Imaging Using a Toner Blend Containing Microencapsulated Precursors for Three Different Colors In an analogous manner as described above, multicolor images are formed using a single toner bath comprised of a mixture of three different encapsulated toners, each containing either a cyan, magenta or yellow dye precursor. All three toners are co-deposited from a toner blend during the electrostatic imaging. Each color-producing toner in the blend contains a specific photoinitiator (or photoinitiator-sensitizer system) sensitive to a given wavelength distinct from the other (generally two or more) photoinitiator(s) contained in the other color toner particles in the blend. Three or more different lasers, each with a wavelength corresponding to that causing reaction of one of the photoinitiators are then used to selectively harden toner particles within the toned image. The toned and exposed image is then developed as described in the preceding examples to provide a multicolor image. Thus, for example, in a given region laser irradiation producing photohardening of the cyan-producing toner particles only would yield the color red in the final image by the release of yellow and magenta, while yellow would be produced by a region in which both the cyan-producing toner particles and the magenta-producing toner particles were hardened by the appropriate laser exposures. A lamp and filters could also be used in place of the lasers if desired. Imaging could also occur by transmitted or reflected light. A toner producing black could also be included in the toner blend and utilized in the same manner if desired.

What is claimed is:

1. A color imaging method which comprises the steps of:

(a) forming a latent image on a photoconductive or dielectric substrate, (b) electrostatically depositing a blended toner composition onto the latent image or onto a discharged surface of said substrate to form a toned image which is a positive or reverse image as compared to said latent image, said blended toner composition comprising at least two different toners, each of said toners comprising a color precursor contained in photo-sensitive toner particles, (c) selectively photohardening or photosoftening at least a portion of said toner particles by imagewise exposure to appropriate wavelengths of radiation to provide harder toner particles and softer, rupturable toner particles, (d) transferring said harder toner particles and said rupturable toner particles to a copy surface, (e) rupturing at least a portion of said toner particles on said copy surface to release color precursor(s) from said rupturable toner particles, and (f) contacting said released color precursor(s) on said copy surface with a developer, thereby causing said released color precursor(s) and said color developer to react to form a color image on said copy surface.

2. The method of claim 1 wherein said blended toner composition comprises at least three types of toner particles, each of said types containing a different color precursor, and each of said types additionally containing a radiation-sensitive composition.

3. The method of claim 2 wherein each of said types of toner particles contains a different color precursor selected from the group consisting of cyan, yellow, magenta, and optionally additionally black.

4. The method of claim 2 wherein said radiation-sensitive material is a photohardenable or photosoftenable material and includes a photoinitiator for each of said types of toner particles, said photoinitiator being sensitive to a given wavelength of light distinct from the light sensitivity of each other photoinitiator contained in each other of said types of toner particles.

5. The method of claim 4 wherein said radiation-sensitive composition is photohardenable and consists essentially of a photoinitiator and a polymerizable or crosslinkable material.

6. The method of claim 4 wherein said radiation-sensitive material is photosoftenable and consists essentially of a depolymerizable material.

7. The method of claim 6 wherein said radiation-sensitive material additionally contains a photoinitiator.

8. A color imaging method which comprises the steps of:

(a) forming a latent image on a photoconductive or dielectric substrate, (b) electrostatically depositing a blended toner composition onto the latent image or onto a discharged surface of said substrate to form a toned image which is a positive or reverse image as compared to said latent image, said blended toner composition comprising at least two different toners, each of said toners comprising a color precursor contained in photo-sensitive toner particles, (c) selectively photohardening or photosoftening at least a portion of said toner particles by imagewise exposure to appropriate wavelengths of radiation to provide harder toner particles and softer, rupturable toner particles, (d) rupturing at least a portion of said toner particles on said substrate to release color precursor(s) from said rupturable toner particles, (e) transferring said released color precursor to a copy surface, and (f) contacting said released color precursor(s) on said copy surface with a developer, thereby causing said released color precursor(s) and said color developer to react to form a color image on said copy surface.

9. The method of claim 8 wherein said blended toner composition comprises at least three types of toner particles, each of said types containing a different color precursor, and each of said types additionally containing a radiation-sensitive composition.

10. The method of claim 9 wherein each of said types of toner particles contains a different color precursor selected from the group consisting of cyan, yellow, magenta, and optionally additionally black.

11. The method of claim 9 wherein said radiation-sensitive material is a photohardenable or photosoftenable material and includes a photoinitiator for each of said types of toner particles, said photoinitiator being sensitive to a given wavelength of light distinct from the light sensitivity of each other photoinitiator contained in each other of said types of toner particles.

12. The method of claim 11 wherein said radiation-sensitive composition is photohardenable and consists essentially of a photoinitiator and a polymerizable or crosslinkable material.

13. The method of claim 11 wherein said radiation-sensitive material is photosoftenable and consists essentially of a depolymerizable material.

14. The method of claim 13 wherein said radiation-sensitive material additionally contains a photoinitiator.

15. A color imaging method which comprises the steps of:

(a) forming a latent image on a photoconductive or dielectric substrate, (b) electrostatically depositing a blended toner composition onto the latent image or onto a discharged surface of said substrate to form a toned image which is a positive or reverse image as compared to said latent image, said blended toner composition comprising at least two different toners, each of said toners comprising a color precursor contained in photo-sensitive toner particles, (c) transferring said toned image to a copy surface, (d) selectively photohardening or photosoftening at least a portion of said toner particles by imagewise exposure to appropriate wavelengths of radiation to provide harder toner particles and softer, rupturable toner particles, (e) rupturing at least a portion of said toner particles on said copy surface to release color precursor(s) from said rupturable toner particles, and (f) contacting said released color precursor(s) on said copy surface with a developer, thereby causing said released color precursor(s) and said color developer to react to form a color image on said copy surface.

16. The method of claim 15 wherein said blended toner composition comprises at least three types of toner particles, each of said types containing a different color precursor, and each of said types additionally containing a radiation-sensitive composition.

17. The method of claim 16 wherein each of said types of toner particles contains a different color precursor selected from the group consisting of cyan, yellow, magenta, and optionally additionally black.

18. The method of claim 16 wherein said radiation-sensitive material is a photohardenable or photosoftenable material and includes a photoinitiator for each of said types of toner particles, said photoinitiator being sensitive to a given wavelength of light distinct from the light sensitivity of each other photoinitiator contained in each other of said types of toner particles.

19. The method of claim 18 wherein said radiation-sensitive composition is photohardenable and consists essentially of a photoinitiator and a polymerizable or crosslinkable material.

20. The method of claim 18 wherein said consists essentially of a depolymerizable material.

21. The method of claim 20 wherein said radiation-sensitive material additionally contains a photoinitiator.

22. The method of claim 1 wherein said blended toner composition is comprised of particle forms selected from the group consisting of microcapsules, microsponges, softenable solid particles, emulsion micelles, and combinations thereof.

* * * * *

UNITED STATES PATENT AND TRADEMARK OFFICE

CERTIFICATE OF CORRECTION

PATENT NO. : 4,869,981

DATED : September 26, 1989

INVENTOR(S) : Feagin A. Wing, Jr., Roger W. Day, and Willard F. Burt

It is certified that error appears in the above—identified patent and that said Letters Patent is hereby corrected as shown below:

In Column 2, line 30, after the word on insert --said copy surface with a developer to--.

In Column 4, line 30 after the word toner insert --particles are ruptured, the photosensitive composition--.

In Column 7, line 11 correct the spelling of "doner" to --donor--; at line 12 insert hyphen in ethylenemaleic to read --ethylene-maleic--; at line 17 after the word the insert --blender power setting was increased to 90 volts for 45--; at line 18 delete "blender power setting was increased to 90 volts for 45"; at line 21, before the word modified, insert --(a--; at line 39 correct the spelling of "electrostatic" to --dielectric--; at line 42 correct the spelling of "electrostatic" to --dielectric--.

In Column 8, line 4 correct the spelling of "passe" to --passed--; at line 32 after the word not insert --been hardened. This resulted in an image that had--.

In Column 12, line 23 after the word said insert --radiation-sensitive material is photosoftenable and--.

Signed and Sealed this

Twenty-fifth Day of February, 1992

*Attest:*

HARRY F. MANBECK, JR.

*Attesting Officer*

*Commissioner of Patents and Trademarks*